US005197635A

United States Patent [19]

Chang

[11] Patent Number: 5,197,635

[45] Date of Patent: Mar. 30, 1993

[54] VARIABLE THRUST CAULK DISPENSING DEVICE

[76] Inventor: Peter J. Y. Chang, 11001 Petersborough Dr., Rockville, Md. 20852

[21] Appl. No.: 614,238

[22] Filed: Nov. 16, 1990

[51] Int. Cl.[5] ..... B67D 5/52

[52] U.S. Cl. ..... 222/137; 222/309; 222/391

[58] Field of Search ..... 222/135, 137, 145, 309, 222/326, 327, 391; 285/1, 304

[56] References Cited

U.S. PATENT DOCUMENTS

| | | | |
|---|---|---|---|
| 2,674,469 | 4/1954 | Earle et al. | 285/1 X |
| 3,174,653 | 3/1965 | McEachran | 222/181 |
| 3,311,265 | 3/1967 | Creighton, Jr. et al. | 222/137 |
| 3,520,331 | 7/1970 | Lock et al. | 285/304 X |
| 3,894,663 | 7/1975 | Carhart et al. | 222/309 |
| 3,905,365 | 9/1975 | Colombo | 222/309 X |
| 4,081,112 | 3/1978 | Chang | 222/391 |
| 4,135,644 | 1/1979 | Pacetti | 222/81 |
| 4,330,070 | 5/1982 | Doubleday | 222/391 X |
| 4,339,058 | 7/1982 | Wendt | 222/309 |
| 4,390,115 | 6/1983 | Bigham | 222/326 |
| 4,461,407 | 7/1984 | Finnegan | 222/391 |
| 4,471,888 | 9/1984 | Herb et al. | 222/145 X |
| 4,538,920 | 9/1985 | Drake | 366/177 |
| 4,566,610 | 1/1986 | Herb | 222/137 |
| 4,664,298 | 5/1987 | Shew | 222/309 X |
| 4,753,536 | 6/1988 | Spehar et al. | 366/339 |
| 4,802,607 | 2/1989 | Johnson | 222/391 X |
| 4,826,050 | 5/1989 | Murphy et al. | 222/309 X |
| 4,827,977 | 5/1989 | Fink, Jr. | 285/304 X |
| 4,907,727 | 3/1990 | Ernst et al. | 222/386 |
| 4,951,843 | 8/1990 | Paetow | 222/145 |

FOREIGN PATENT DOCUMENTS

| | | |
|---|---|---|
| 1413047 | 11/1964 | France . |
| 1011470 | 12/1965 | United Kingdom . |

*Primary Examiner*—Kevin P. Shaver
*Assistant Examiner*—Joseph A. Kaufman
*Attorney, Agent, or Firm*—Leonard Bloom

[57] ABSTRACT

An improved single and double cylinder hand-operated caulking gun having a direct plunger drive mechanism including a bearing assembly for increasing trigger leverage to allow delivery of a dense composition at a high volume and flow rate. The caulking gun of the present invention includes an adjustable trigger stop for minimizing hand fatigue during prolonged use, quick-release pistons, and a dual-cartridge restraining screw.

9 Claims, 6 Drawing Sheets

VARIABLE THRUST CAULK DISPENSING DEVICE

FIELD OF THE INVENTION

The present invention relates to dispensing devices, and more particularly to a hand-held caulk dispensing gun.

DESCRIPTION OF THE BACKGROUND

Caulking guns are used to dispense a wide variety of fluid compositions such as urethane, vinyl, polyester, epoxy and other plastics. These compositions are often very dense, yet the caulking gun must be capable of applying the composition over a wide range of volumetric flow rates. In order to achieve higher flow rates, prior art caulking guns were necessarily small in size. Otherwise, the force required to operate the caulking gun would exceed the capabilities of the operator. Consequently, complex gear-drives and pneumatic caulking guns were developed to overcome the problem. However, these improved caulking guns share a common characteristic. They are very expensive to manufacture and produce. There is a clear demand for an inexpensive hand-held caulking gun capable of delivering a dense composition at a high delivery volume and flow rate. U.S. Pat. No. 4,081,112 issued to Chang addresses the demand. The Chang caulking gun positions the trigger pivot and trigger drive grip engagement above the plunger shaft. This improvement increases the leverage obtainable by a hand operated trigger and allows delivery of the composition at a higher volume and flow rate than was previously possible in a hand-held caulking gun. Moreover, the improvement can be accomplished at no additional cost.

Nevertheless, there is an ever increasing demand for a hand-operated caulking gun having more power and improved features.

SUMMARY OF THE INVENTION

It is therefore an object of the present invention to provide an improved caulking gun capable of delivering a dense composition at a high volume and flow rate.

It is another object of the invention to provide the above-described caulking gun at a minimum manufacturing expense.

It is still another object of the present invention to incorporate the above-described advantages in a twin cylinder caulk dispenser for use in delivering complementary compositions such as epoxy resin and hardener.

It is yet another object of the present invention to provide a caulk dispenser which is convenient to use, and which minimizes hand fatigue resulting from prolonged use.

According to the present invention, the above described and other objects are accomplished by providing a frame, a plunger including a plunger shaft for forwardly urging a caulking composition, plunger driving means including a housing having a downwardly extending handle, a first grip enclosed within the housing, said first grip encircling the plunger shaft and protruding upwardly beyond the plunger shaft to a location proximate an upper portion of the housing, a trigger pivoted to the housing and extending upwardly within the housing to a trigger pivot located above the plunger shaft, a bearing bit mounted on a portion of said trigger above the pivot, said bearing bit operatively engaging the upward protrusion of the first grip, and the first grip being driven by the bearing bit for advancing the plunger, a first compression spring oppositely biasing the first grip against the operative engagement with the bearing bit, and plunger pressure retaining means including a second grip and second spring, the second grip biased by the second spring and having a portion operable for releasing plunger pressure whereby the plunger can be manually retracted.

BRIEF DESCRIPTION OF THE DRAWINGS

Other features and advantages of the present invention become apparent from the following detailed description of preferred embodiments and certain modifications thereof when taken together with accompanying drawings, in which.

DETAILED DESCRIPTION OF THE PREFERRED EMBODIMENTS

Figure 1:
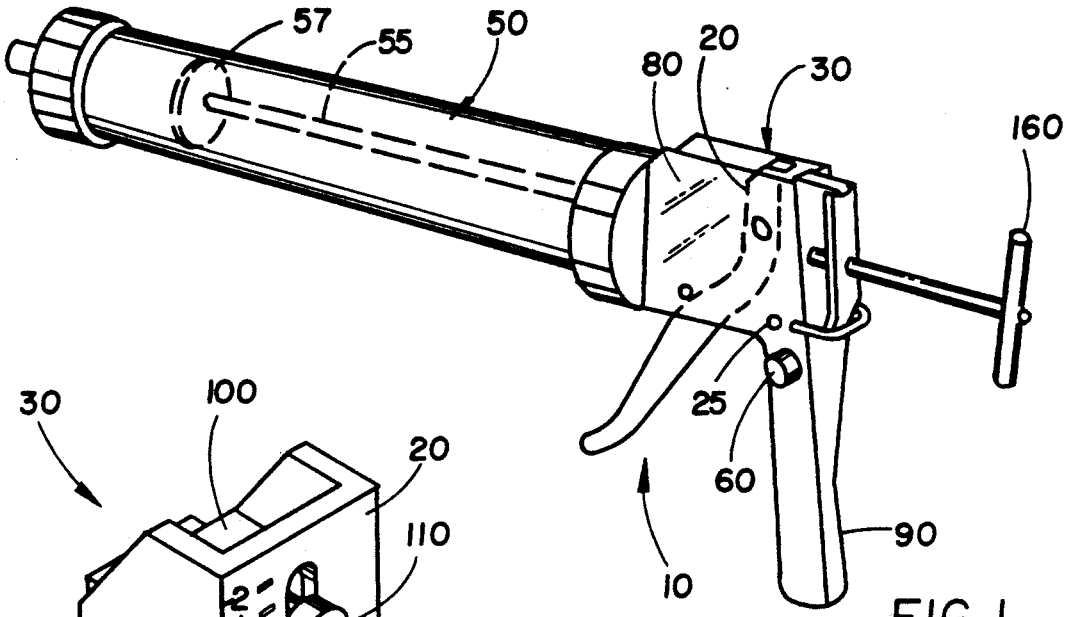
FIG. 1 is a perspective view of a caulking gun according to one embodiment of the present invention.

FIG. 1 is a perspective view of a manually operated caulking gun according to the present invention. The caulking gun includes a plunger 50 having a plunger shaft 55 which is driven by an improved plunger drive assembly. The drive assembly includes a housing 80, and a trigger 10 pivoted at a screw hinge 40 located piston above shaft 55. As described in U.S. Pat. No. 4,081,112 issued to Chang, screw hinge 40 is located above piston rod 50 to increase the trigger leverage. The drive assembly further includes a bearing assembly 30 located on a portion 20 of trigger 10 which extends above screw hinge 40. In addition, a trigger stop mechanism 60 is provided on downwardly extending handle 90 to adjust the arc of trigger 10 for reducing hand fatigue.

Figure 2:
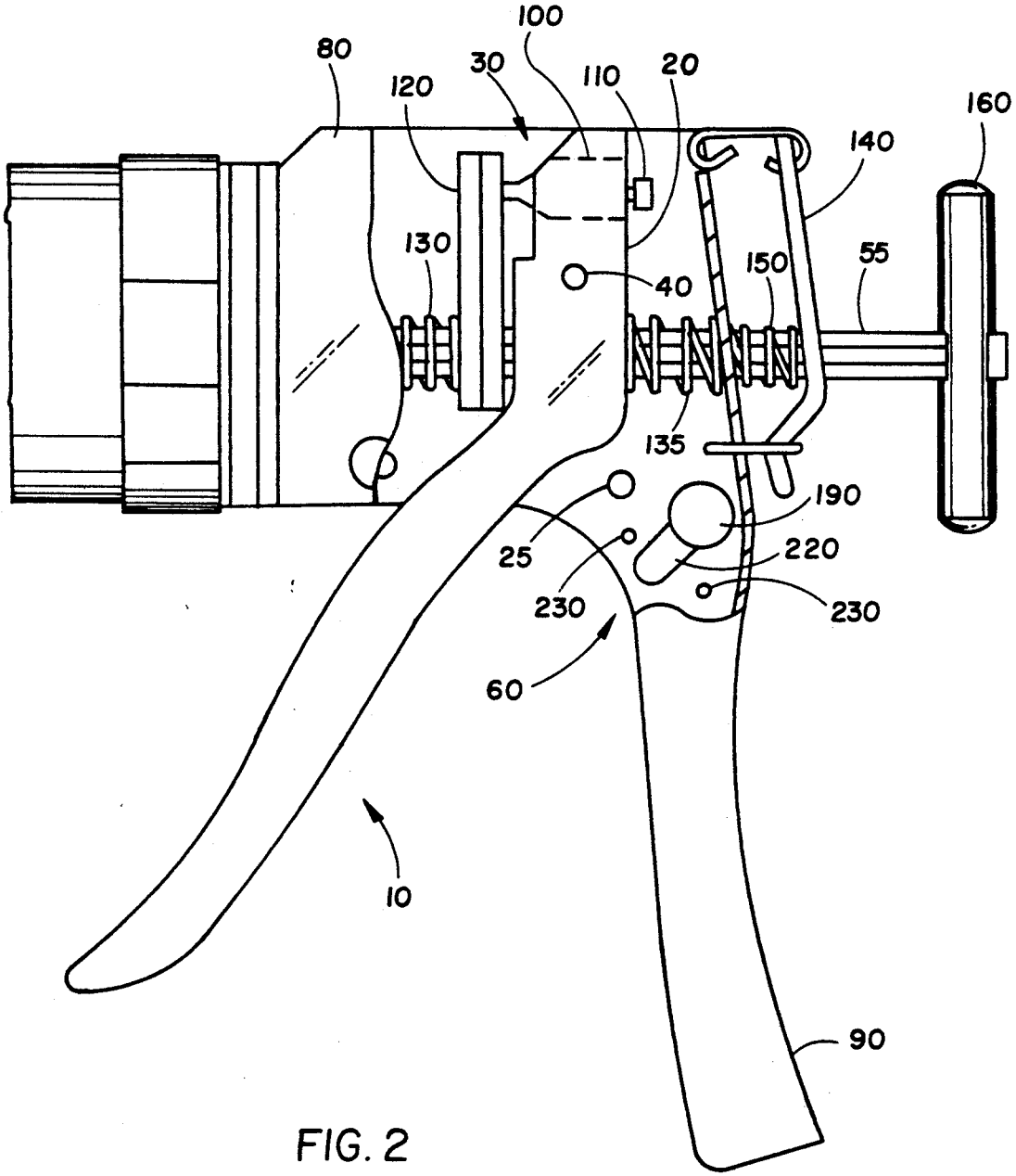
FIG. 2 is a break-away view of the internal assembly of a caulk dispenser having an adjustable bearing assembly in accordance with the embodiment shown in FIG. 1.

FIG. 2 shows a break-away view of the improved drive assembly of FIG. 1. Plunger shaft 55 extends through, and is carried by housing 80. Trigger 10 extends upwardly into housing 80, straddles plunger shaft 55, and is pivotally fixed to housing 80 at a screw hinge 40 located above plunger shaft 55. A portion 20 of trigger 10 extends past screw hinge 40. Bearing assembly 30 includes a bearing bit 100 adjustably secured by set screw 110 to the upwardly extending portion 20 of trigger 10. A first gripping member 120 is carried by plunger shaft 55 and is biased away from the left wall of housing 80 and into bearing bit 100 by compression spring 130. The resilient bias is imparted to trigger 10 through bearing bit 100. An opposite resilient bias is imparted on trigger 10 by compression spring 135. A second grip 140 extends downwardly from the top of housing 80 and straddles plunger shaft 55. Grip 140 pivots at the top of housing 80 and is outwardly biased by compression spring 150.

In operation, trigger 10 is depressed and pivots about screw 20 hinge 40. Bearing bit, 100, which is carried on the upper portion 20 of trigger 10, is forced against grip 120 as trigger 10 is depressed. As grip 120 is pressed forward, it engages plunger shaft 55 and causes plunger shaft 55 to be driven forward through housing 80. As trigger 10 is released, it is biased back to its original position by compression spring 135. Likewise, grip 120 returns to its original position as a result of spring 130. However, grip 140 engages plunger shaft 55 to prevent the shaft from back-sliding. The above-described operation is repeated to drive the plunger shaft 55 incrementally forward until the caulk cylinder is depleted and/or the operator desires to stop. At this point the portion of grip 140 extending downwardly below plunger shaft 55 can be depressed, thereby releasing all pressure on plunger shaft 55. An operator may grasp knob 160 for convenient extraction of plunger 50 from a caulk cylinder (not shown). The caulk cylinder can then be easily removed and discarded.

Figure 3:
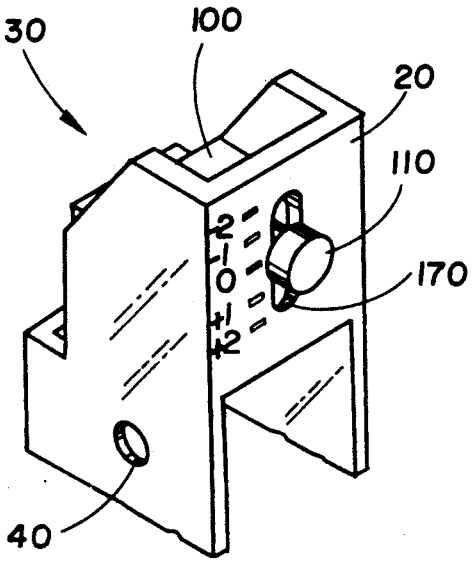
FIG. 3 is a perspective view of the adjustable bearing assembly of FIG. 2.
Figure 4:
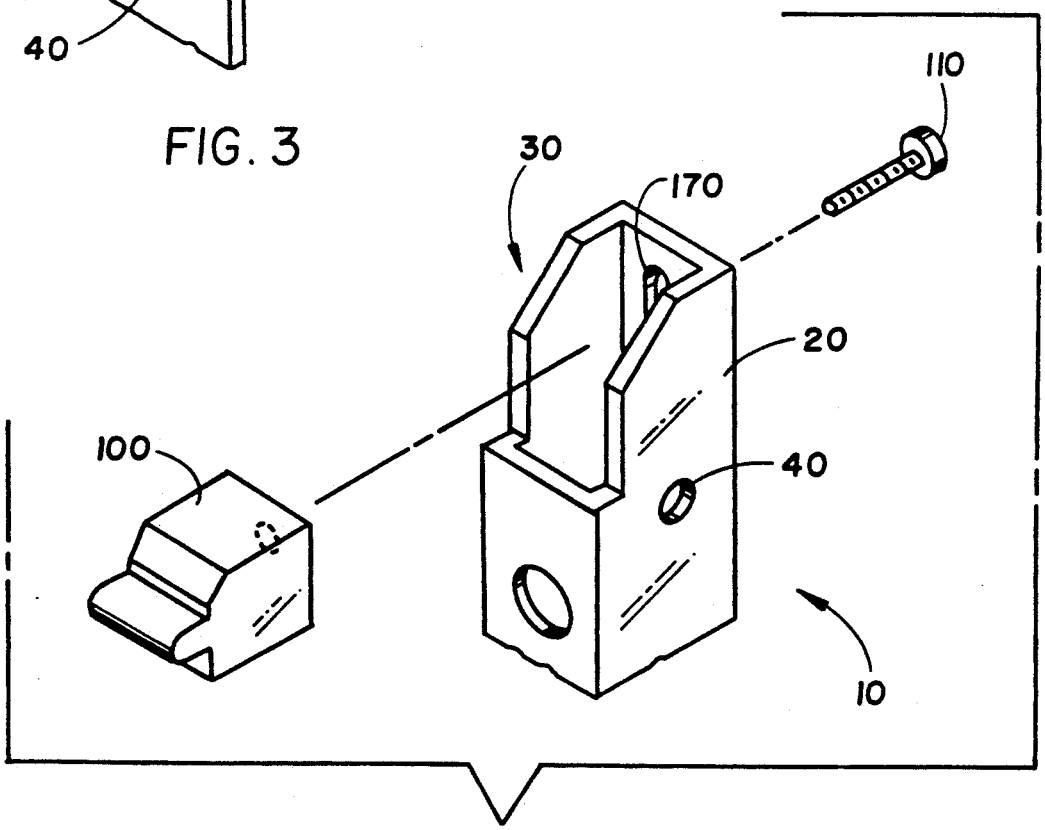
FIG. 4 is an assembly diagram of the adjustable bearing assembly of FIG. 2.

FIG. 3 and FIG. 4 give a more detailed illustration of bearing bit 100 and its mounting. Bearing bit 100 is a low friction insert which may be formed of brass, oil impregnated sintered metal, a polymer, or any other known low-friction material. Bearing bit 100 slides across the face of grip 120 as trigger 10 is pivoted. The composition and shape of bearing bit 100 are carefully chosen to minimize friction despite the perpendicular caulking force exerted between grip 120 and bearing bit 100.

Bearing bit 100 is mounted on an upper portion 20 of trigger 10 which extends above screw hinge 40. Elongated slot 170 is formed through trigger 10, and set screw 110 is threaded through slot 170 into the rear of bearing bit 100. The head of set screw 110 straddles the elongated slot 170. This way, when set screw 110 is tightened, bearing bit 100 is secured against trigger 10. The position of bearing bit 100 can be adjusted upwardly or downwardly along the upper portion of trigger 10 depending on the seating of set screw 110 within elongated slot 170. This adjustment allows the leverage of trigger 10 against grip 120 to be increased or decreased accordingly. If bearing bit 100 is seated low on the upper portion 20 of trigger 10, then the leverage is maximized and a greater force can be exerted on plunger shaft 55. Conversely, if bearing bit 100 is seated high upon trigger 10, then the leverage is minimized and plunger shaft 55 can be moved in larger increments. Additionally, an index may be provided adjacent to slot 170 for facilitating the positioning of bearing bit 100. Set screw 110 can be aligned with the index to achieve a predetermined leverage.

When an operator desires to cease dispensing the composition, he may depress grip 140. This frees the plunger shaft 55, thereby releasing the compressive force.

The invention may be provided with a bore hole 25, as shown in FIGS. 1 and 2, through one side of handle 90. The conventional cartridge tip provided on a caulk cylinder may be inserted through bore hole 25, and the tip may be severed by pivoting trigger 10 against handle 90. Thus, the caulk dispenser of the present invention provides an additional convenience by severing the tip of a new caulk cylinder.

Figure 5:
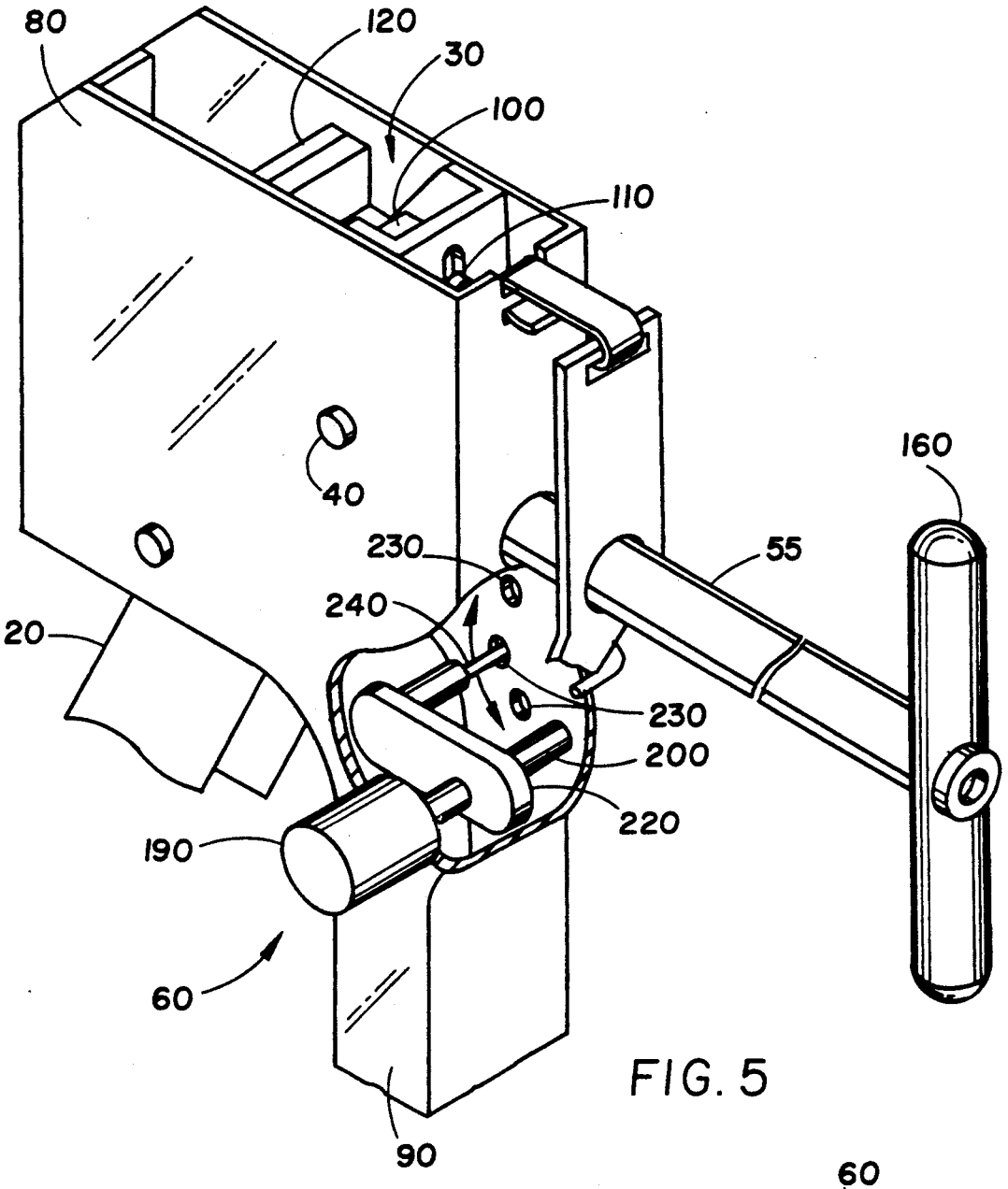
FIG. 5 is a break-away view of caulking gun of FIG. 1 showing a trigger stop mechanism according to the present invention.
Figure 6:
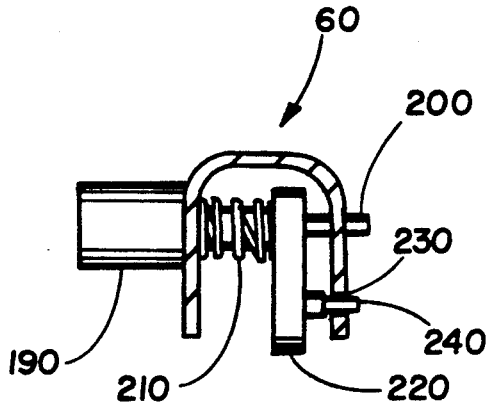
FIG. 6 is a bottom view of the trigger stop mechanism of FIG. 5.

FIGS. 5 and 6 detail a trigger stop mechanism 60 which may be used to limit the arc of trigger 10 when depressed. It has been found that shortening the arc of trigger 10 helps to alleviate hand fatigue. Trigger stop 60 comprises a knob 190 mounted on a stem 200 which passes through and is carried by handle 90. The rotation of knob 190 causes rotation of stem 200. A strut 220 is mounted on stem 200 inside handle 90. Rotation of knob 190 causes strut 220 to pivot around stem 200. A pin 240 extends from the opposite end of strut 220 toward one side of handle 90. Pin 240 fits within one of a number of holes 230 which are equidistant from stem 200. A compression spring 210 biases strut 220 such that pin 240 will remain seated in one of the holes 230. Knob 190 can be pulled away from handle 90 and rotated in order to extract and position pin 240 in another of the holes 230. In this manner, an operator can align strut 220 in different angles with respect to trigger 90. The arc in which trigger 90 is free to swing is determined by the alignment of strut 220. By limiting the arc of trigger 90, an operator can reduce hand fatigue when dispensing a large amount of caulk over time.

Figure 7:
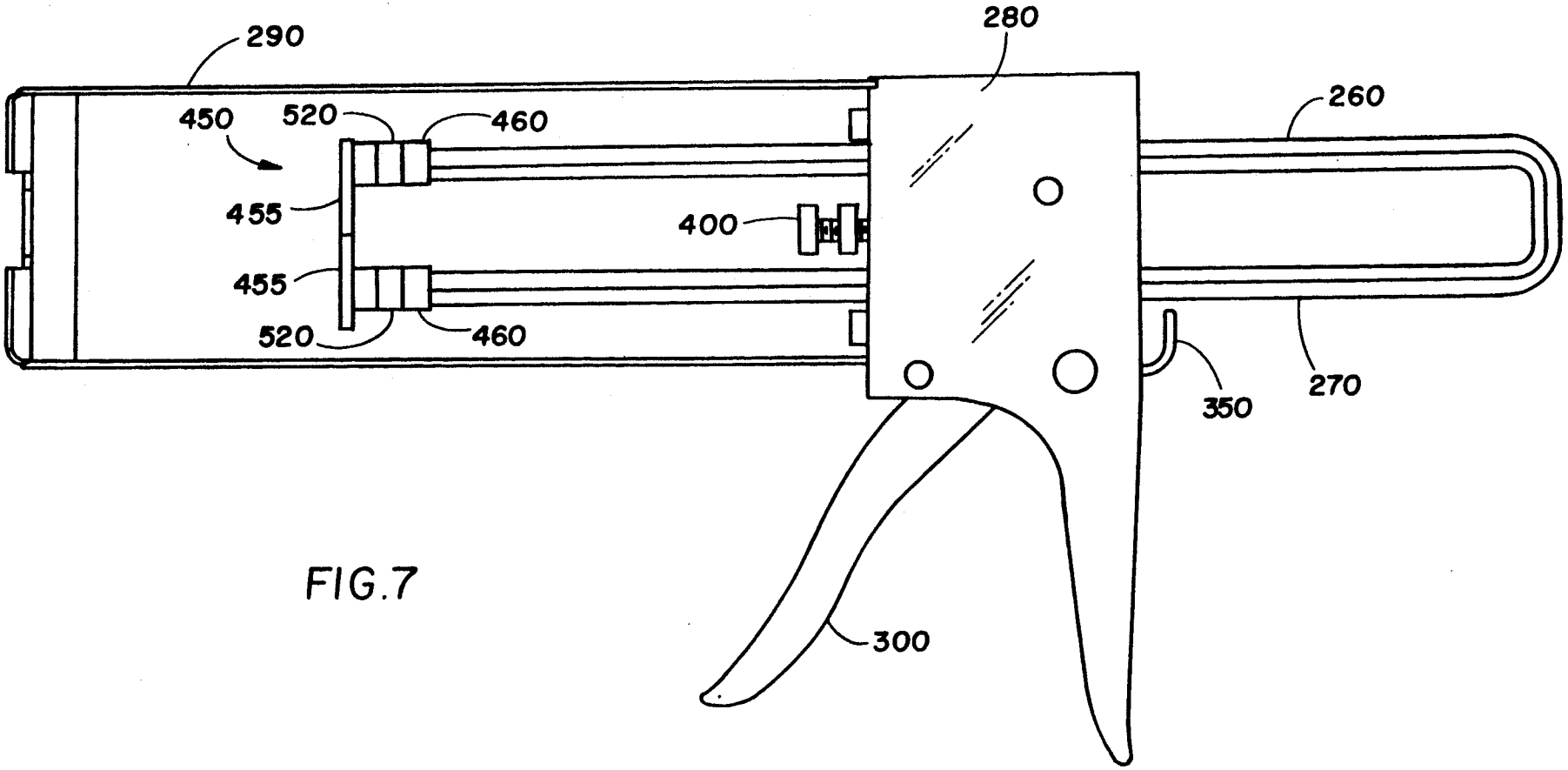
FIG. 7 is a perspective view of a dual cylinder caulk dispenser according to another embodiment of the present invention.

FIG. 7 shows another embodiment of the invention in which the above-described features are incorporated in a dual cylinder caulking gun. The dual cylinder caulking gun operates with two parallely spaced plunger shafts 260 and 270 which are joined at one end. A housing 280 carries both plunger shafts 260 and 270, which both extend through and are carried by housing 280. Frame 290 is designed to accommodate a twin cartridge for dispensing compositions which must be mixed immediately prior to application. The resin and hardener which mix to form epoxy cement are typical examples of such compositions.

Figure 8:
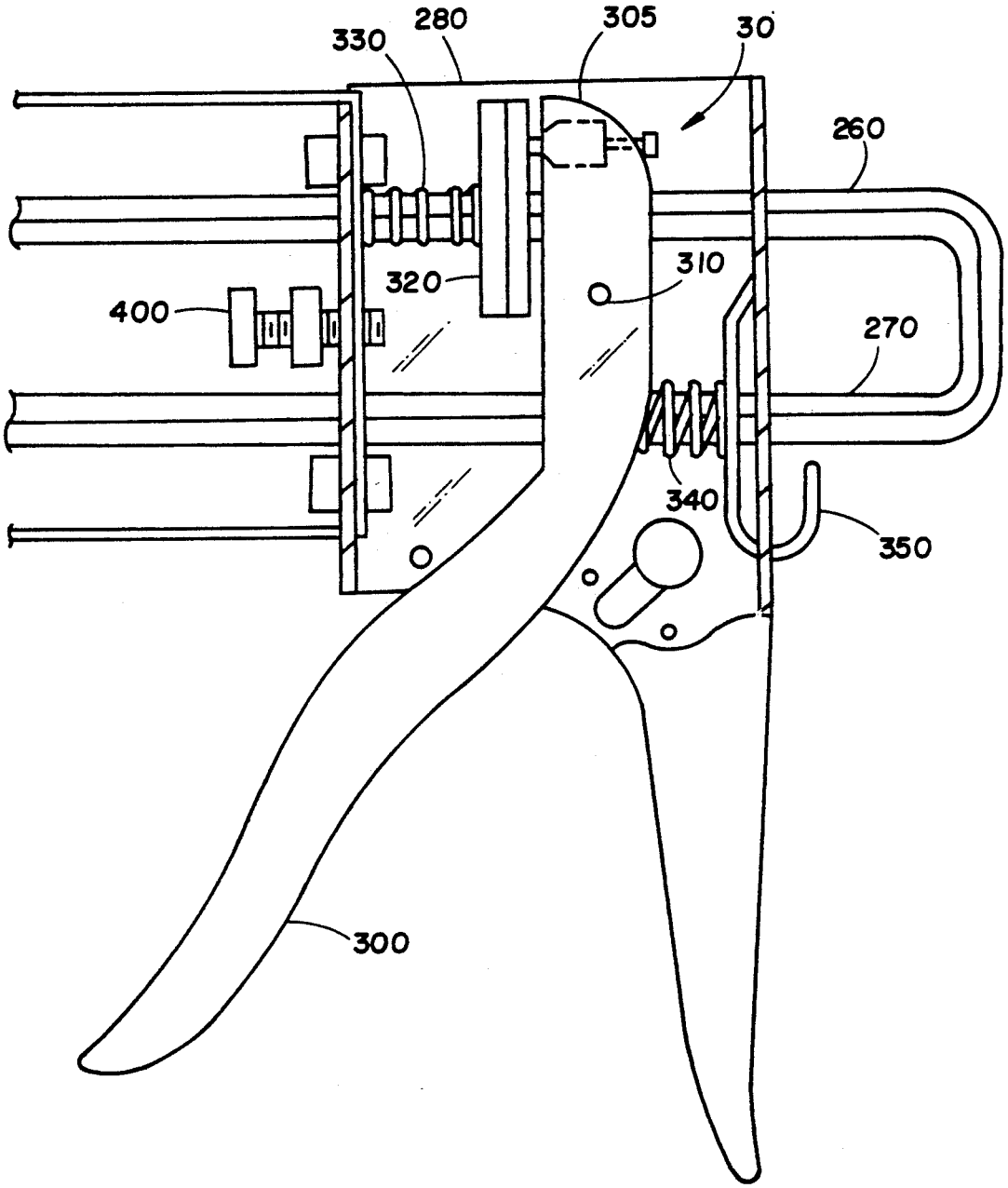
FIG. 8 is a break-away view of the caulking gun of FIG. 7 showing the improved drive mechanism according to the present invention.

FIG. 8 shows a break-away view of the improved drive assembly of FIG. 1 adapted for use in a dual cylinder caulking gun. Trigger 300 extends upwardly into housing 280, straddles the lower plunger shaft 270, and is pivotally fixed to housing 280 at a screw hinge 310 located above lower plunger shaft 270. A portion 305 of trigger 300 extends past screw hinge 310 toward upper plunger shaft 260. A first gripping member 320 is carried by upper plunger shaft 260 and is biased away from the left wall of housing 280 by compression spring 330. The resilient bias is imparted to trigger 300. An identical bearing assembly 30 as shown in FIGS. 1–4 may also be incorporated in the dual cylinder caulking gun. Compression spring 340 imparts an opposing resilient bias to trigger 300. A second grip 350 extends downwardly from inside housing 280, straddles lower plunger shaft 270, and protrudes upwardly outside housing 280.

In operation, trigger 300 is depressed and pivots about screw hinge 310. The upper portion 305 of trigger 300, including bearing assembly 30, drives grip 320 as trigger 300 is depressed. As grip 320 is driven forward it engages upper plunger shaft 260 and drives both shafts 270 and 260 forward through housing 280. As trigger 300 is released, it is biased back to its original position by compression spring 340. Likewise, grip 320 returns to its original position as a result of spring 330. However, grip 350 will engage plunger shaft 270 to prevent the shafts 260 and 270 from back-sliding. The above-described operation is repeated to drive both plunger shafts 270 and 260 incrementally forward until the caulk cylinder is depleted and/or the operator desires to stop. At this point grip 350 can be depressed to release all pressure on plunger shaft 270. An operator may grasp the junction of plunger shafts 260 and 270 for convenient extraction from a twin caulk cylinder (not shown). The caulk cylinder can then be easily removed and discarded.

By operating directly on upper plunger shaft 280, the drive mechanism of the present invention operates more easily than prior art dual cylinder caulking guns, yet the manufacturing costs are lower.

In addition, a twin caulk cartridge may be secured in place by tightening screw 400 which is threaded into the left wall of housing 280. The head of screw 400 abuts the caulk cylinder and, when extended, secures the cylinder against frame 290.

Snap-on piston assemblies 450 are also provided at the ends of plunger shafts 260 and 270.

Figure 9:
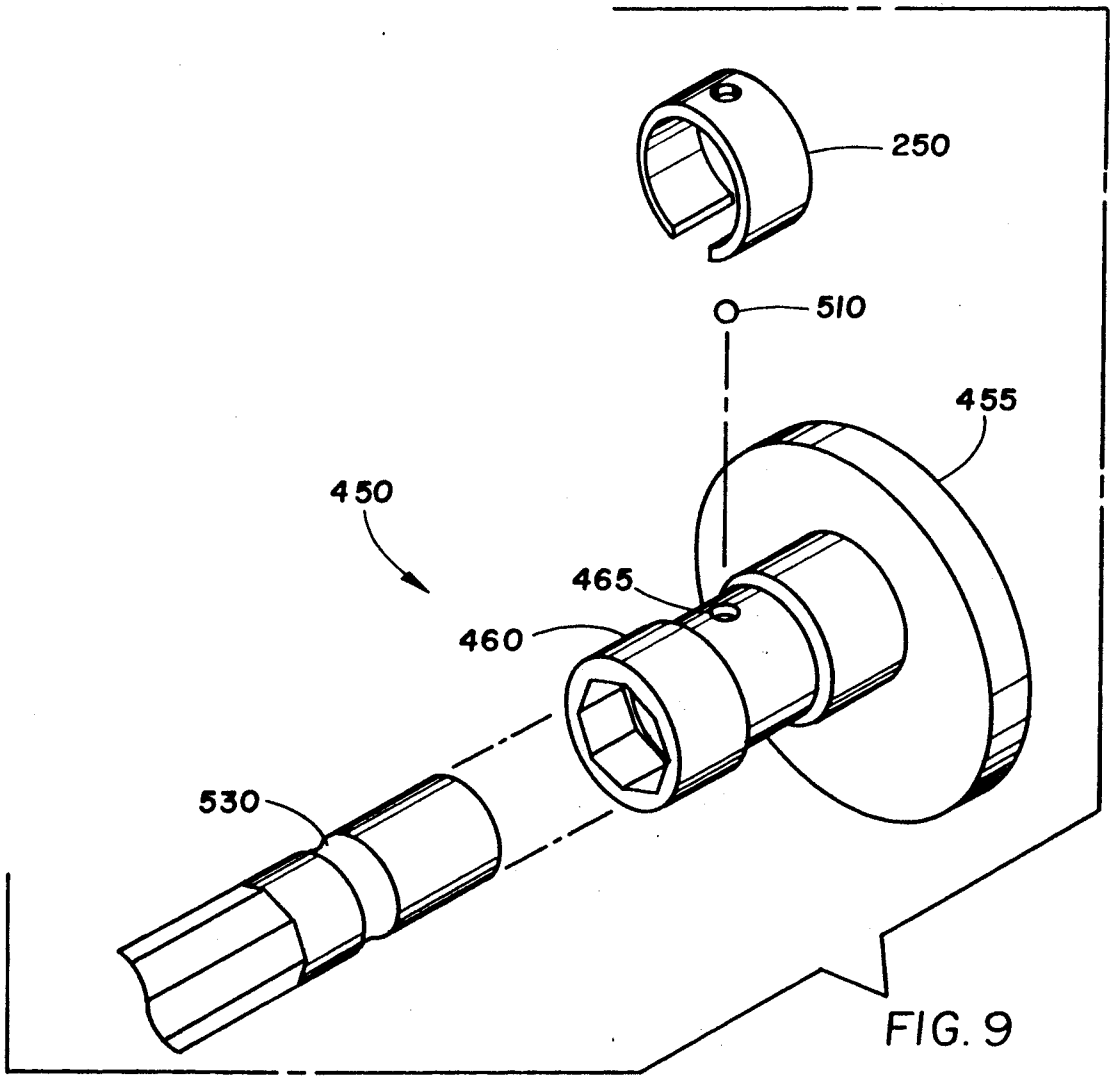
FIG. 9 is a detailed diagram of the piston assembly of FIG. 7.

FIG. 9 illustrates a snap-on piston assembly 450 in more detail. Piston assembly 450 includes a piston 455, and a hollow cylindrical base 460 on which piston 455 is mounted. The mid-section of base 460 is defined by a reduced diameter channel. A small bore hole 465 extends from the outer periphery of the channel through a wall of base 460 to the hollow thereof. The diameter of bore hole 465 is tapered to provide a seating for a small ball bearing 510. Ball bearing 510 sits within bore hole 465 such that the section of the periphery of ball bearing 510 extends slightly into the hollow of base 460. A compression ring 520 fits over ball bearing 510 and sits flush within the recessed channel of base 460. Compression ring 520 biases ball bearing 510 towards the hollow of base 460. An annular groove 530 is cut into the end of each plunger shaft. When the plunger shaft is fully inserted within base 460, ball bearing 510 extends into groove 530 such that piston 455 is releasibly locked on the end of the plunger shaft. A sharp pull on piston 455 will overcome the compressive force of band 520 and piston 455 can be removed from the shaft. Many shapes and sizes of pistons 455 may be easily interchanged with this assembly in order to accommodate the various twin caulk cartridges now available.

Various modifications and alterations of this invention will be apparent to those skilled ion the art without departing from the spirit and scope of the invention.

I claim:

1. A caulking gun, comprising:

a frame;

a plunger including a plunger shaft for forwardly urging a caulking composition;

plunger driving means, said plunger driving means further comprising, a housing having a downwardly extending handle, a first grip enclosed within said housing, said first grip being linked to the plunger shaft and protruding upwardly beyond the plunger shaft;

a trigger pivot located above said plunger shaft;

a trigger extending upwardly within the housing and pivoting about said trigger pivot;

a bearing bit mounted on a portion of said trigger above said trigger pivot, said bearing bit providing a direct slidable engagement along a face of said first grip, and said bearing bit operating to cam the first grip as said trigger is pivoted to grip and advance the plunger;

adjustable mounting means for adjustably retaining said bearing bit on said trigger, said mounting means allowing said bearing bit to be positioned and secured along said portion of said trigger above said trigger pivot;

a first compression spring oppositely biasing said first grip against the operative engagement with said bearing bit; and plunger pressure retaining means including a second grip and second spring, the second grip being biased by the second spring and having a portion operable for releasing plunger pressure to allow manual retraction of said plunger.

2. The caulking gun according to claim 1, wherein said mounting means further comprises, an elongate slot formed in said portion of said trigger above said trigger pivot, and a set screw passing through said slot and threaded into said bearing bit for retaining said bearing bit against said trigger.

3. The caulking un according to claim 2, wherein said portion of said trigger above said trigger pivot is defined by indicia adjacent said slot for gauging a position of said bearing bit.

4. A twin-cylinder caulking gun, comprising:

a frame;

a dual plunger including parallel first and second plunger shafts for forwardly urging caulking material from a cartridge, said first and second plunger shafts being joined at one end;

plunger driving means for driving said dual plunger by operating directly on said first plunger shaft, said plunger driving means further comprising, a housing having a downwardly extending handle, a first grip enclosed within said housing, said first grip being linked to said first plunger shaft, a trigger pivot located above said second plunger shaft, a trigger extending upwardly within said housing and pivoting about said trigger pivot, an upper portion of the trigger extending upwardly within the housing past said trigger pivot and directly and frictionally engaging said first grip, said first grip being driven by said upper trigger portion for advancing the dual plunger, a first compression spring oppositely biasing said first grip against the operative engagement with the upper trigger portion; and dual plunger pressure retaining means including a second grip and second spring, the second grip biased by the second spring and having a portion operable for releasing dual plunger pressure to allow manual retraction of said plunger;

an adjustable trigger stop for limiting a pivoting arc of said trigger, said adjustable trigger stop further comprising an elongate strut housed within said handle for engaging said trigger when pivoted, a stem passing through said handle and through one end of said strut, a selecting knob mounted on said stem externally of said handle for selecting an incremental pivoting arc of said trigger by alignment of said strut, whereby a side of said handle is formed with a plurality of bore-holes spaced equidistant from said stem, and another end of said strut is provided with a protruding pin positionable by operation of said selecting knob within one of said bore-holes to allow incremental selection of a pivoting arc of said trigger.

5. A twin-cylinder caulking gun, comprising:

a frame;

a dual plunger including parallel first and second plunger shafts for forwardly urging caulking material from a twin-cylinder cartridge, said first and second plunger shafts being joined at one end;

plunger driving means for driving said dual plunger by operating directly on said first plunger shaft, said plunger driving means further comprising, a housing having a downwardly extending handle, a first grip enclosed within said housing, said first grip being linked to said first plunger shaft and protruding upwardly beyond said first plunger shaft, a trigger pivot located above said second plunger shaft, a trigger extending upwardly within said housing and pivoting about said trigger pivot, an upper portion of said trigger extending upwardly in the housing beyond said trigger pivot and straddling said first plunger shaft, a bearing bit mounted on said upper portion of said trigger above said first plunger shaft, said bearing bit providing a direct slidable engagement along a face of said first grip, and said bearing bit operating to cam the first grip as said trigger is pivoted to grip and advance the dual plunger, an adjustable mounting for retaining said bearing bit on said trigger, said mounting allowing said bearing bit to be positioned and secured along said upper portion of said trigger, a first compression spring oppositely biasing said first grip against the operative engagement of said bearing bit; and plunger pressure retaining means including a second grip and second spring, the second grip biased by the second spring and having a portion operable for releasing dual plunger pressure to allow manual retraction of said dual plunger.

6. The caulking gun according to claim 5, wherein said mounting further comprises, an elongate slot formed in said upper portion of said trigger, and a set screw passing through said slot and threaded into said bearing bit for retaining said bearing bit against said trigger.

7. The caulking gun according to claim 6, wherein said portion of said trigger above said trigger pivot is defined by indicia adjacent said slot for gauging a position of said bearing bit.

8. A twin-cylinder caulking gun, comprising:

a frame;

a dual plunger including parallel first and second plunger shafts for forwardly urging caulking material from a twin-cylinder cartridge, said first and second plunger shafts being joined at one end;

quick-release pistons mounted on another end of the first and second plungers, said pistons being adapted to snap on and off of said first and second plungers;

dual plunger driving means for driving said dual plunger by operating directly on said first plunger shaft, said plunger driving means further comprising, a housing having a downwardly extending handle, a first grip enclosed within said housing, said first grip being linked to said first plunger shaft, a trigger pivoted to the handle, the trigger operatively engaging said first grip, and said first grip being driven by said trigger for advancing the dual plunger, a first compression spring oppositely biasing said first grip against the operative engagement with said trigger;

dual plunger pressure retaining means including a second grip and second spring, the second grip being biased by the second spring and being operable to release dual plunger pressure to allow manual retraction of said dual plunger; and stabilizing means for securing a twin-cartridge within said frame, said stabilizing means further comprising a stabilizing screw mounted on a forward wall of said housing and protruding outward to the twin-cartridge, said stabilizing screw having a head biasing said cartridge, whereby said stabilizing screw can be screwed outward from said forward wall to forcibly hold said twin cartridge within said frame.

9. A caulking gun, comprising:

a frame;

a plunger including a plunger shaft for forwardly urging a caulking composition;

a plunger driving means, said plunger driving means further comprising, a housing having a downwardly extending handle, a first grip enclosed within said housing, said first grip being linked to the plunger shaft and protruding upwardly beyond the plunger shaft;

a trigger pivot located above said plunger shaft;

a trigger extending upwardly within the housing and pivoting about said trigger pivot;

an adjustable trigger stop for limiting a pivoting arc of said trigger to a predetermined arc, said adjustable trigger stop further comprising an elongate strut housed within said handle for restricting a pivoting arc of said trigger, a stem passing through said handle and through one end of said strut, and a selecting knob mounted on said stem externally of said handle for selecting a pivoting arc of said trigger by alignment of said strut, a side of said handle being defined by a plurality of bore-holes spaced equidistantly from said stem, and another end of said strut having a protruding pin positionable by said selecting knob within one of said bore-holes to allow incremental selection of said pivoting arc of said trigger;

a bearing bit mounted on a portion of said trigger above said trigger pivot, said bearing bit directly and frictionally engaging said first grip, and said first grip being driven by said bearing bit for advancing the plunger;

a first compression spring oppositely biasing said first grip against the operative engagement with said bearing bit; and plunger pressure retaining means including a second grip and second spring, the second grip being biased by the second spring and having a portion operable for releasing plunger pressure to allow manual retraction of said plunger.

* * * * *